US005528879A

United States Patent [19]

Louy et al.

[11] Patent Number: 5,528,879

[45] Date of Patent: Jun. 25, 1996

[54] APPARATUS FOR APPLYING CLOSURES TO CONTAINERS

[75] Inventors: John A. Louy, Waterville; Lynn Ruple, Swanton, both of Ohio

[73] Assignee: Diversified Capping Equipment, Inc., Perrysburg, Ohio

[21] Appl. No.: 452,323

[22] Filed: May 26, 1995

[51] Int. Cl.[6] ..... B67B 3/28; B67B 3/20; B65B 7/28

[52] U.S. Cl. ..... 53/201; 53/331.5; 53/368

[58] Field of Search ..... 53/201, 317, 331.5, 53/490, 368, 334

[56] References Cited

U.S. PATENT DOCUMENTS

| | | |
|---|---|---|
| 675,020 | 5/1901 | Schmick . |
| 1,154,348 | 9/1915 | Story . |
| 2,143,935 | 1/1939 | Chandler . |
| 2,154,457 | 4/1939 | Knapp . |
| 2,861,470 | 11/1958 | Baker . |
| 2,959,967 | 11/1960 | Metzner . |
| 3,344,685 | 10/1967 | Crouzet . |
| 5,038,824 | 8/1991 | Hyde et al. . |
| 5,040,426 | 8/1991 | Wueller . |
| 5,176,036 | 1/1993 | Harris . |
| 5,218,811 | 6/1993 | Laplante et al. . |
| 5,357,827 | 10/1994 | Natwick et al. . |
| 5,417,031 | 5/1995 | Bankuty et al. . |
| 5,423,159 | 6/1995 | Bankuty et al. . |

*Primary Examiner*—Horace M. Culver
*Attorney, Agent, or Firm*—MacMillan, Sobanski & Todd

[57] ABSTRACT

Apparatus for applying closures to containers includes a plurality of cam followers, closure tightening mechanisms associated with the cam followers to tighten closures on the container, a cam assembly having an annular cam groove for receiving the cam followers, and a cam insert positioned along a portion of the length of the cam assembly The cam insert is moveable between a first position and a second position to change the path of the cam followers between a first path and a second path, where the first path causes the cam followers to move relative to the cam assembly at a first rate, thereby causing the closure tighteners to tighten closures on the containers at a first rate, and the second path causes the cam followers to move relative to the cam assembly at a second rate, thereby causing the closure tighteners to tighten closures on the containers at a second rate.

20 Claims, 5 Drawing Sheets

APPARATUS FOR APPLYING CLOSURES TO CONTAINERS

BACKGROUND OF THE INVENTION

This invention relates in general to apparatus for applying closures to containers in which the closures must be threaded onto the containers. In particular, this invention relates to tightening mechanisms which exert a downwardly directed rotating force on closures in order to secure the closure onto the container.

Many systems are known for filling containers with a product, such as a liquid, and for automatically applying closures to the containers. Typically the containers are glass or plastic, and the closures are plastic or metallic. The closures are threaded, as are the necks or openings of the containers. Empty containers are sequentially fed through a filling station where the containers are filled, and then they are fed through a capping machine where the closures are applied. Rotary capping machines apply the closures or lids, and &ire the lids downwardly while rotating them to threadably secure the lids onto the container. High speed capping machines are capable of operating at rates of up to 750 containers per minute or higher. Closure application and tightening mechanisms are well known in the art.

A typical capping machine includes a closure applying apparatus having a torque applying capacity for threading the lids onto the containers. Also, the closure applying apparatus will have means, such as magnets, for holding the lids and depositing them on the containers. A clutch mechanism enables the lids to be tightened to a specified torque. Further, the closure applying apparatus has a means for driving the lid downwardly onto the container during the threading of the lids onto the containers. A commonly used method for driving the lid downwardly involves providing a cam assembly positioned along the path of the containers, and connecting the closure applying apparatus with a cam follower which tracks the cam groove in the cam assembly. The cam groove can be adapted to change the relative distance of the cam follower to the containers (i.e., move the cam follower closer to the container), thereby causing the closure applying apparatus to move downwardly so that the lid will be driven down onto the container.

A common practice in the industry is to provide a downwardly sloping portion in the cam groove to drive the lids onto the container. The slope of the cam groove is designed to fit the desired slope or pitch of the threads on the container. For example, if the lid has lug threads, the lid must descend fully onto the container during the time for about ¼ of a rotation of the lid. For a continuous threaded closure, however, the lid must descend fully onto the container during the time for about 3 complete rotations of the lid. Various lids having different pitches require different descent times to apply the lids when the rotative rate or force is generally constant.

A problem with present day capping machines is that they have fixed cam grooves designed to apply lids having threads of a fixed pitch. In order to run the capping machine for both lug threaded lids and continuous threaded lids, the entire cam assembly, or at least the portion of the cam assembly having the lid descending slope, must be removed and replaced. The replacement portion will have an appropriate slope for the desired lid. Changing even a portion of the cam assembly requires extensive labor and machine downtime because of the complexity of the capping machine. Any improvement facilitating the changeover from one cam slope to another in capping machines would be a useful improvement in the art.

SUMMARY OF THE INVENTION

There has now been developed a machine for applying closures to containers in which the cam slope can be changed from one pitch to another. The cam assembly is provided with a cam insert along a portion of its length. The cam insert is moveable to provide two different paths, one with a relatively steep slope accommodating a lug-type lid and the other having a relatively gentle slope for applying lids having continuous threads. Since the insert is moveable, the capping machine can be switched from one type of lid to the other without dismantling portions of the capping machine.

The apparatus for applying closures to containers includes a cam assembly having an annular cam groove for receiving cam followers. Closure tightening mechanisms are connected to the cam followers, and the movement of the cam followers within the cam groove dictates the vertical position of the closure tightening mechanisms. Downward movement of the cam followers causes the closure tightening mechanism to give the lids down onto the containers. A cam insert is positioned along a portion of the length of the cam assembly. The cam insert is moveable between a first position and a second position to change the path of the cam followers between a first or gradual path and a second or steeper path. The first path causes the cam followers to move relative to the cam assembly at a first rate, thereby causing the closure tighteners to tighten closures on the containers at a first rate. The second path causes the cam followers to move relative to the cam assembly at a second rate, thereby causing the closure tighteners to tighten closures on the containers at a second rate.

The cam follower preferably comprises a follower base, a base guide, and an insert guide. The annular cam groove has an inner portion, the insert cam groove, and an outer portion, the base cam groove. Preferably, the insert guide is a roller, and the base guide is a roller, where the base roller has a larger diameter than the diameter of the insert roller. This enables the cam follower to track within the cam groove.

In a particular embodiment of the invention, during travel of the cam followers along the first or gradual path, the top surface of the base guide roller contacts the upper surface of the base cam groove, and the bottom surface of the insert guide roller contacts the lower surface of the insert cam groove. Also, during travel of the cam followers along the second or steeper path, the bottom surface of the base guide contacts the lower surface of the base cam groove, and the top surface of the insert guide contacts the upper surface of the insert cam groove.

DETAILED DESCRIPTION OF THE PREFERRED EMBODIMENT

Figure 1:
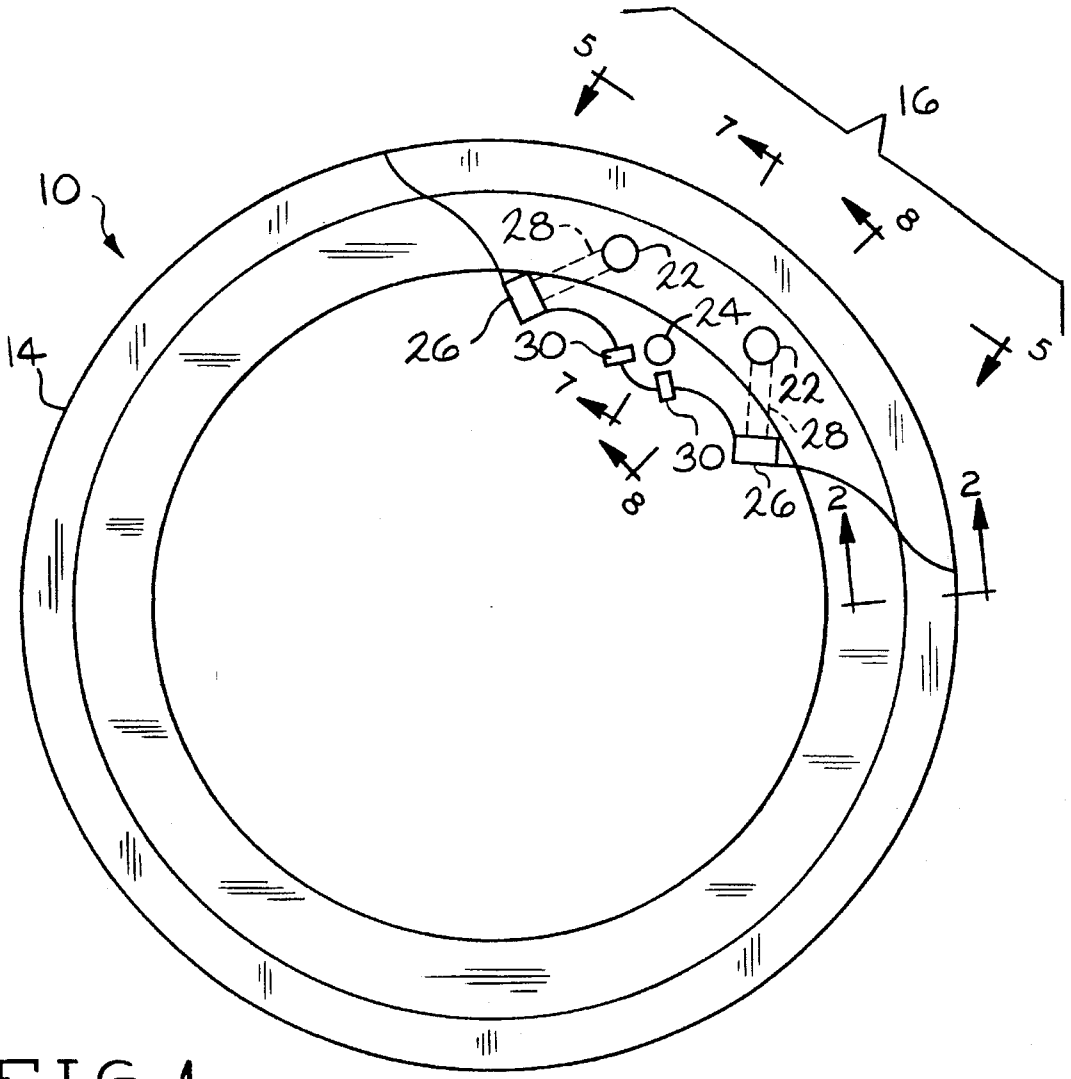
FIG. 1 is a schematic plan view of a cam assembly of the invention.

Referring now to the drawings, the apparatus for applying closures includes cam assembly 10, illustrated in FIG. 1. The cam assembly has an annular cam groove 12, shown in FIG. 2, to guide the cam followers around the periphery of the cam assembly. The cam assembly is generally comprised of cam base 14 and cam insert 16. The cam insert is positioned in a portion of the periphery of the cam assembly. The cam insert can be designed to cover any portion of the circumference of the cam assembly, including the entire 360° of the cam assembly, although usually a smaller portion of the circumference, such as about 50° will suffice for purposes of applying the lids to the containers. Although the cam assembly shown is circular, it is to be understood that the cam assembly can be of any shape, and can provide a cam groove following a non-circular path, such as a linear path. Also, the cam assembly is shown as being horizontal, but other embodiments of the invention include the cam assembly in orientations other than horizontal.

Figure 2:
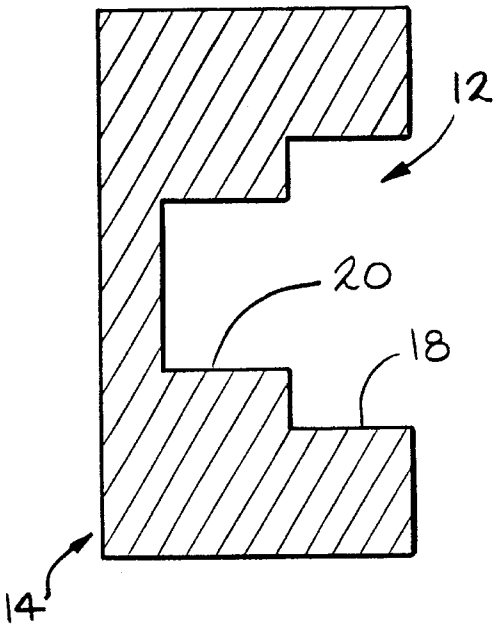
FIG. 2 is a schematic cross-sectional view in elevation of the cam base taken along lines 2—2 of FIG. 1.

As can be seen in FIG. 2, the cam base 14, which is the portion of the cam assembly 10 not containing the cam insert, has an annular cam groove 12 which includes a base cam groove 18 and an insert cam groove 20. Preferably, the base cam groove is wider that the insert cam groove.

The cam insert 16 is moveable vertically (into and out of the plane of FIG. 1) to shift the path for the traveling cam followers from a first path to a second path. The cam insert can be mounted in any manner to be shiftable from one position to another. As shown, the cam insert is mounted for slidable movement along guide shafts 22. The movement of the cam insert can be accomplished by any suitable means, such as by lift cylinder 24, more clearly shown in FIG. 7. The lift cylinder can be hydraulic or pneumatic.

Figure 8:
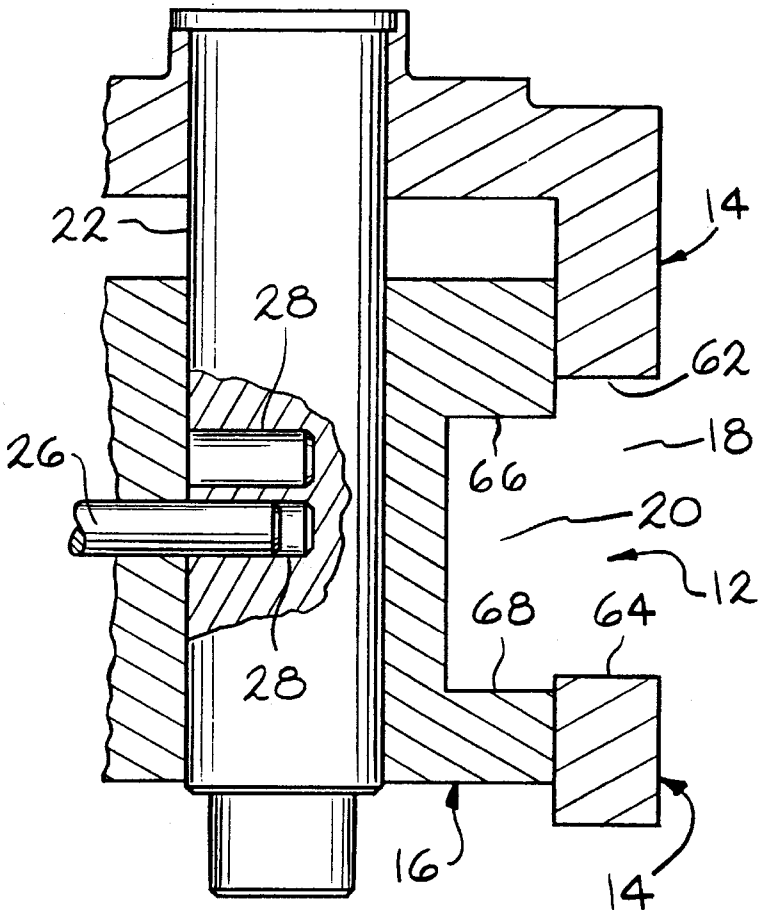
FIG. 8 is a schematic cross-sectional view in elevation of the cam base taken along lines 8—8 of FIG. 1, with the cam insert in the shifted down position.
Figure 7:
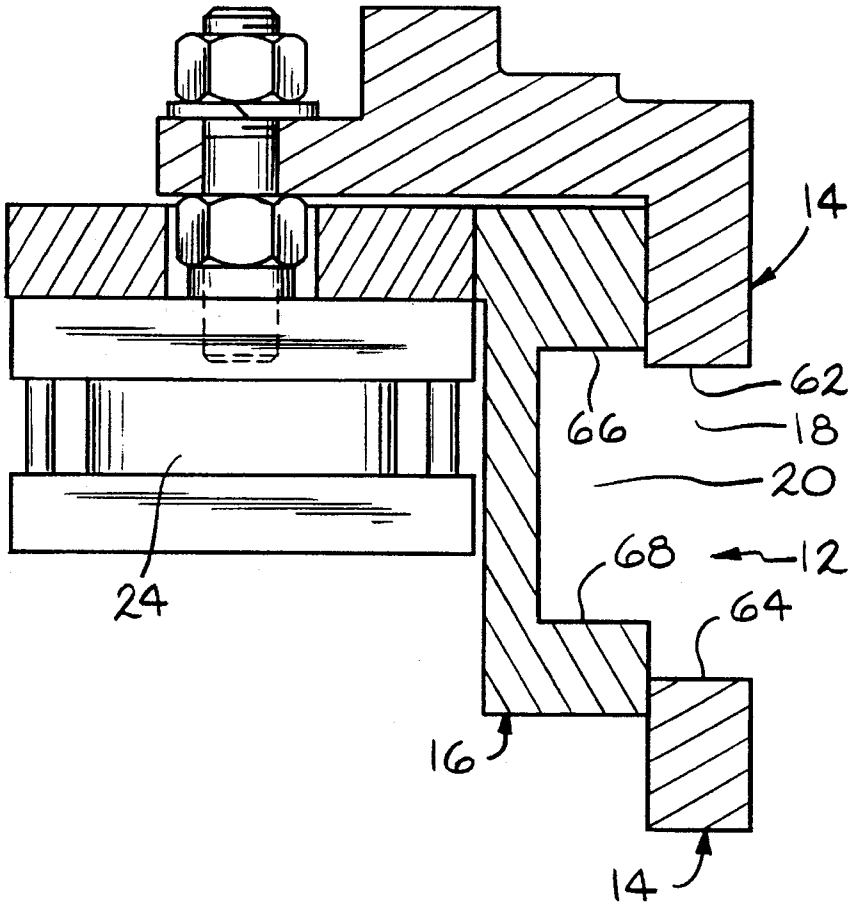
FIG. 7 is a schematic cross-sectional view in elevation of the cam base and cam insert taken along lines 7—7 of FIG. 1, with the cam insert in the shifted up position.

In order to positively assure that the cam insert 16 is completely locked into the shifted up position, as shown in FIG. 7, or completely locked into the shifted down position shown in FIG. 8, the cam insert can be provided with locking pins 26. The locking pins are moveable into and out of locking pin slots 28 positioned in the guide shafts 22. In operation, the locking pins are retracted from one of the locking pin slots, the cam insert 16 is shifted from one position to another, and the locking pins are reinserted into the other of the locking pin slots. The locking pins can be operated manually, or can be connected to a controller which is adapted to coordinate the shifting of the cam insert from one position to another. Optionally, sensors, such as optical sensors 30, can be positioned on the cam insert and governed by the controller to sense the vertical position of the cam insert vis-à-vis a non-shiftable part.

Figure 3:
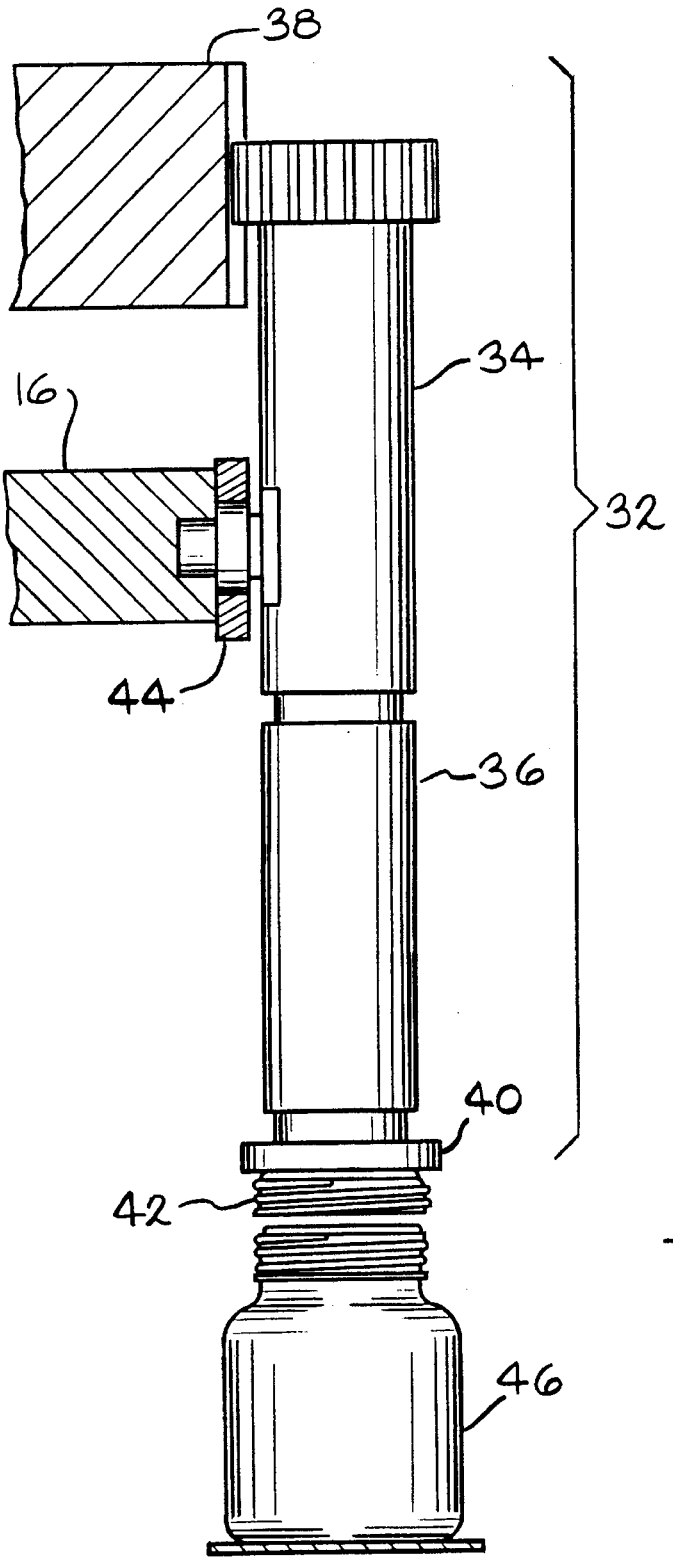
FIG. 3 is a schematic view in elevation of the cam assembly and closure tightening mechanism applying a lid to a container.

The apparatus for rotating closures and applying them to containers is well known in the art. As shown in FIG. 3, the closure tightening mechanism 32 includes spindle 34 and clutch 36. The spindles can be mounted for rotation by engagement with bull gear 38 or by any other suitable means. A chuck 40 is positioned at the bottom of the closure tightening mechanism to hold the lids 42 during the capping operation. Various types of torque applicators can also be used. Non-metallic lids must be held by closure gripping apparatus, not shown.

A cam follower 44 is positioned to follow the annular cam groove around the periphery of the cam base 14 and the cam insert 16. The cam follower is operatively connected to the spindle 34 so that vertical movement of the cam follower will move the spindle in a similar vertical manner. Therefore, when the cam follower is given downward by the path of the cam groove, the spindle and the entire closure tightening mechanism will be moved downward by a similar distance. Driving the closure tightening mechanism downward applies the lid to the container 46, and the rotation of the spindle causes the lid to be rotated for threadable engagement with the threads on the container. The rate at which the cam follower moves downwardly dictates the rate at which the lid will be screwed onto the container. Variations in the operation of the cam follower and the closure tightening mechanism can be employed, as is well known in the an of rotary cappers.

Figure 4:
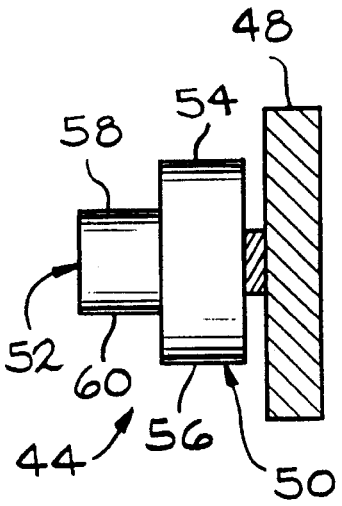
FIG. 4 is a schematic view in elevation illustrating a cam follower.

As shown in FIG. 4, the cam follower is comprised of a follower base 48 which is adapted to be connected to the spindle and to dictate the vertical position of the closure tightening mechanism. A base guide attached to the follower base 48 is designed to follow within the base cam groove 18 in the annular cam groove 12. The base guide can be of any suitable design, such as base roller 50. An insert guide is also attached to the follower base, and it travels within the insert cam groove 20 as the cam follower moves around the periphery of the cam assembly. The insert guide is preferably circular, such as insert roller 52. The base roller, as shown, has a top surface 54 and a bottom surface 56. The insert roller has a top surface 58 and a bottom surface 60. Although the base roller is shown as being larger in diameter than the insert roller, different embodiments of the invention may include a base roller smaller than the insert roller, or a base roller and insert roller of the same size.

Figure 5:
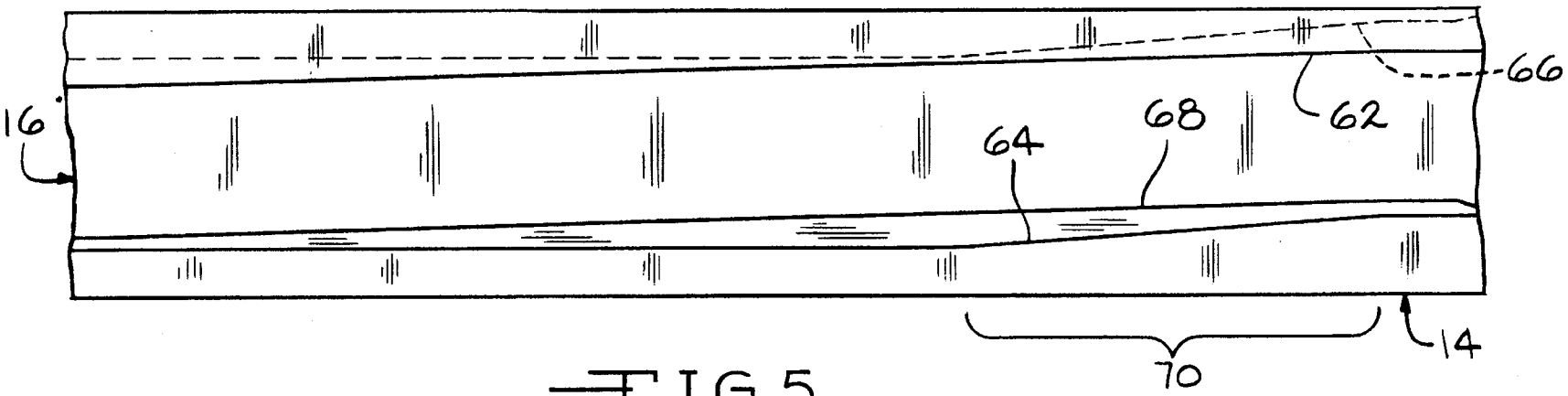
FIG. 5 is a schematic view in elevation showing the cam insert in the shifted up position, taken along line 5—5 of FIG. 1.
Figure 6:
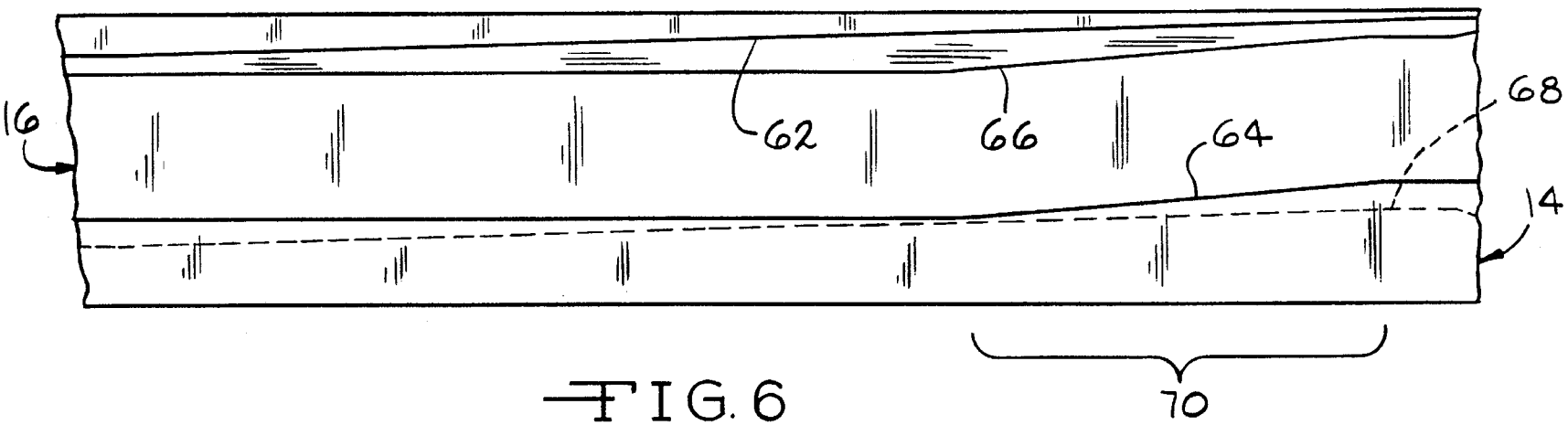
FIG. 6 is a schematic view in elevation of the cam insert similar to that shown in FIG. 5, but with the insert in the shifted down position.

As shown in FIGS. 5 and 7, within the cam insert portion 16 of cam assembly 10, the annular cam groove 12 is comprised of base cam groove 18 and insert cam groove 20. The base cam groove is stationary and is defined by first and second surfaces, such as upper surface 62 and lower surface 64. The insert cam groove 20 is shiftable upwards and downwards, and is defined by first and second surfaces, such as upper surface 66 and lower surface 68. The cam insert is shown shifted up in FIGS. 5 and 7. The shifted down position of the cam insert is shown in FIGS. 6 and 8.

Figure 10:
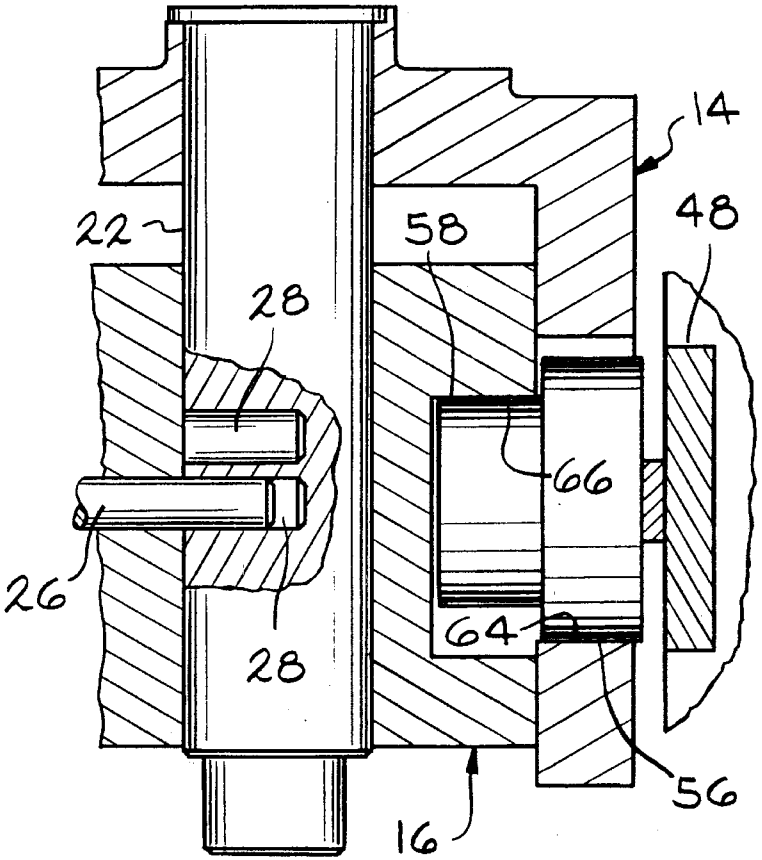
FIG. 10 is a schematic cross-sectional view in elevation of the cam base and cam insert similar to that shown in FIG. 8, with the cam follower positioned within the annular cam groove.
Figure 9:
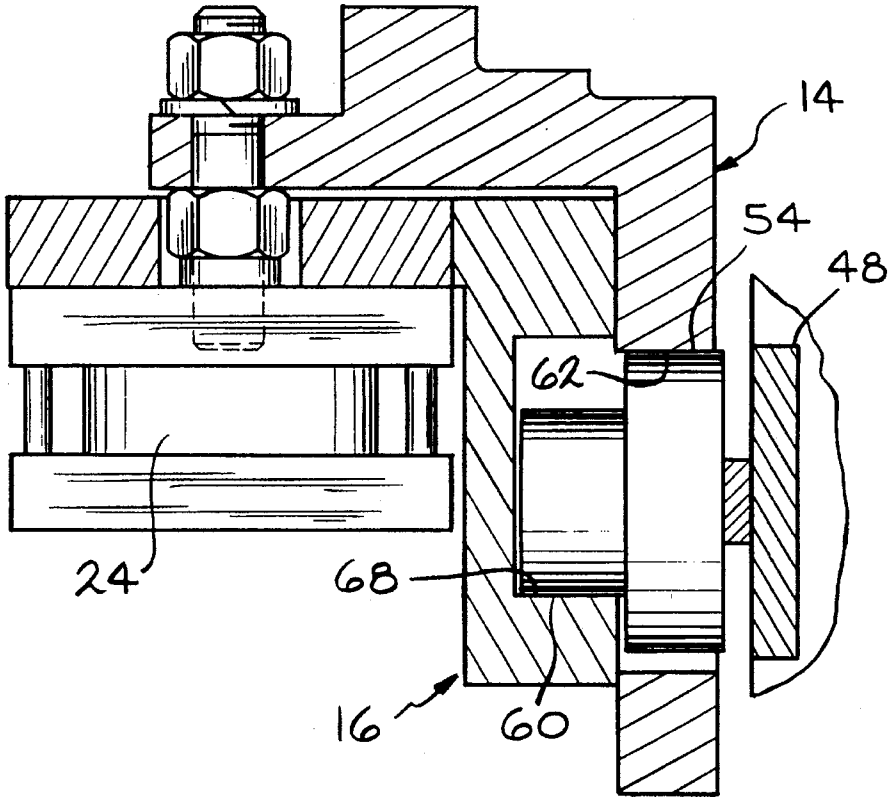
FIG. 9 is a schematic cross-sectional view in elevation of the cam base and cam insert similar to that shown in FIG. 7, with the cam follower positioned within the annular cam groove.

Shifting the cam insert up or down dictates the manner in which the base roller 50 and insert roller 52 contact the surfaces defining the base cam groove 18 and the insert cam groove 20, as shown in FIGS. 9 and 10. In the shifted up position, shown in FIG. 9, the top surface 54 of the base roller comes into contact with the base cam groove upper surface 62, and the bottom surface 60 of the insert roller comes into contact with the insert cam groove lower surface 68. The guiding of the cam follower by the base cam groove upper surface 62 and insert cam groove lower surface 68 will cause the cam follower to travel along first or gradual path defined by the straight lines 62 and 68 shown in FIG. 5. This gradual path is particularly suitable for applying lids having continuous type threads. In one particular embodiment for applying lids having continuous threads, about three rotations of the lids by the spindle of the closure tightening mechanism will occur as the cam follower, lid and container travel through the cam insert portion of the cam assembly. It is to be understood that the slope could be modified to accommodate threads of a different pitch.

When the cam insert is shifted down, as shown in FIG. 10, the cam follower will be guided by the contact between the bottom surface of the base roller 56 and the base cam groove lower surface 64, and by contact between the insert roller top surface 58 and the insert cam groove upper surface 66. The guiding of the cam follower by the base cam groove lower surface 64 and insert cam groove upper surface 66 will cause the cam follower to travel along a second or steeper path defined by the angled lines 64 and 66 shown in FIG. 6. The steeper path occurs in the high slope area 70. This steeper path is appropriate for applying lids having lug-type threads. Since the slope of the path shown in FIG. 10 is relatively steep, only about ¼ of a rotation of the lids by the spindle of the closure tightening mechanism will occur as the cam follower, lid and container travel through the high slope area 70. It is to be understood that the slope could be modified to accommodate threads of a different pitch.

The slopes of the paths shown in FIGS. 9 and 10 are merely representative, and it is to be understood that various slopes of paths can be used with the invention. A preferred ratio of the slope of the gentle path to the steeper path is within the range of from about 1:1.5 to about 1:5. More preferably, the ratio of the slope of the first path to the slope of the second path is within the range of from about 1:2 to about 1:4.

In operation, when the cam insert 16 is in the shifted up position, as the cam follower 44 travels through the cam insert portion 16 of the cam assembly 10, the cam follower will follow a gradual path defined by the base cam groove upper surface 62 and the insert cam groove lower surface 68. The gradual path causes the cam follower and hence the entire closure tightening mechanism to gradually descend to apply the lid 42 onto the container while the spindle rotates the lid about three rotations. When it is desired to change to a container having threads having a steeper pitch, the locking pins 26 are removed from the slots 28, and the lift cylinder 24 is actuated to move the cam insert 16 to the shifted down position. Once shifted, the locking pins are reinserted. The cam follower then follows a relatively steep path defined by the base cam groove lower surface 64 and the insert cam groove upper surface 66. The steeper path in the high slope area 70 causes the cam follower and hence the entire closure tightening mechanism 32 to rapidly descend to apply the lid 42 onto the container while the spindle rotates the lid about ¼ of a rotation.

It will be evident from the foregoing that various modifications can be made to this invention. Such, however are considered as being within the scope of the invention.

What is claimed is:

1. Apparatus for applying closures to containers comprising:

a plurality of cam followers;

closure tightening mechanisms associated with the cam followers to tighten closures on the containers;

a cam assembly having an annular cam groove for receiving the cam followers; and a cam insert positioned along a portion of the length of the cam assembly, the cam insert being moveable between a first position and a second position to change the path of the cam followers between a first path and a second path, where the first path causes the cam followers to move relative to the cam assembly at a first rate, thereby causing the closure tighteners to tighten closures on the containers at a first rate, and the second path causes the cam followers to move relative to the cam assembly at a second rate, thereby causing the closure tighteners to tighten closures on the containers at a second rate.

2. The apparatus of claim 1 in which the cam follower comprises a follower base, a base guide, and an insert guide.

3. The apparatus of claim 2 in which the insert guide is a roller, and the base guide is a roller, where the base roller has a larger diameter than the diameter of the insert roller.

4. The apparatus of claim 1 in which:

the insert guide has first and second surfaces;

and the base guide has first and second surfaces;

the cam insert defines an insert cam groove having first and second surfaces;

the cam base defines a base cam groove having first and second surfaces;

during travel of the cam followers along the first path, the first surface of the base guide contacts the first surface of the base cam groove, and the second surface of the insert guide contacts the second surface of the insert cam groove; and during travel of the cam followers along the second path, the second surface of the base guide contacts the second surface of the base cam groove, and the first surface of the insert guide contacts the first surface of the insert cam groove.

5. The apparatus of claim 2 in which the cam groove of the portion of the circular cam assembly not containing the cam insert comprises a base cam groove and an insert cam groove.

6. The apparatus of claim 5 in which the base cam groove is wider than the insert cam groove.

7. The apparatus of claim 1 in which the ratio of the slope of the first path to the slope of the second path is within the range of from about 1:1.5 to about 1:5.

8. The apparatus of claim 7 in which the ratio of the slope of the first path to the slope of the second path is within the range of from about 1:2 to about 1:4.

9. Apparatus for applying closures to containers comprising:

a plurality of cam followers;

closure tightening mechanisms associated with the cam followers to tighten closures on the containers;

a generally circular cam assembly oriented horizontally and having an annular cam groove for receiving the cam followers; and a cam insert positioned in a portion of the circumference of the cam assembly, the cam insert being vertically moveable between a first position and a second position to change the path of the cam followers between a first path and a second path, where the first path causes the cam followers to move downwardly at a first rate, thereby causing the closure tighteners to tighten closures on the containers at a first rate, and the second path causes the cam followers to move downwardly at a second rate, thereby causing the closure tighteners to tighten closures on the containers at a second rate.

10. The apparatus of claim 9 in which the cam follower comprises a follower base, a base guide, and an insert guide.

11. The apparatus of claim 10 in which the insert guide is a roller, and the base guide is a roller, where the base roller has a larger diameter than the diameter of the insert roller.

12. The apparatus of claim 9 in which:

the insert guide has top and bottom surfaces;

and the base guide has top and bottom surfaces;

the cam insert defines an insert cam groove having upper and lower surfaces;

the cam base defines a base cam groove having upper and lower surfaces;

during travel of the cam followers along the first path, the top surface of the base guide contacts the upper surface of the base cam groove, and the bottom surface of the insert guide contacts the lower surface of the insert cam groove; and during travel of the cam followers along the second path, the bottom surface of the base guide contacts the lower surface of the base cam groove, and the top surface of the insert guide contacts the upper surface of the insert cam groove.

13. The apparatus of claim 10 in which the annular cam groove of the portion of the circular cam assembly not containing the cam insert comprises a base cam groove and an insert cam groove.

14. The apparatus of claim 13 in which the base cam groove is wider than the insert cam groove.

15. The apparatus of claim 9 in which the ratio of the slope of the first path to the slope of the second path is within the range of from about 1:1.5 to about 1:5.

16. The apparatus of claim 15 in which the ratio of the slope of the first path to the slope of the second path is within the range of from about 1:2 to about 1:4.

17. Apparatus for applying closures to containers comprising:

a plurality of cam followers comprising a follower base, an insert roller, and a base roller, where the base roller has a larger diameter than the diameter of the insert roller;

closure tightening mechanisms associated with the cam followers to tighten closures on the containers;

a generally circular cam assembly oriented horizontally and having an annular cam groove for receiving the cam followers; and a cam insert positioned in a portion of the circumference of the cam assembly, the cam insert being vertically moveable between a first position and a second position to change the path of the cam followers between a first path and a second path, where the first path causes the cam followers to move downwardly at a first rate, thereby causing the closure tighteners to tighten closures on the containers at a first rate, and the second path causes the cam followers to move downwardly at a second rate, thereby causing the closure tighteners to tighten closures on the containers at a second rate, where:

the insert roller has top and bottom surfaces;

and the base roller has top and bottom surfaces;

the cam insert defines an insert cam groove having upper and lower surfaces;

the cam base defines a base cam groove having upper and lower surfaces;

during travel of the cam followers along the first path, the top surface of the base roller contacts the upper surface of the base cam groove, and the bottom surface of the base roller contacts the lower surface of the base cam groove; and during travel of the cam followers along the second path, the bottom surface of the base roller contacts the lower surface of the base cam groove, and the top surface of the insert roller contacts the upper surface of the insert cam groove.

18. The apparatus of claim 17 in which the annular cam groove of the portion of the circular cam assembly not containing the cam insert comprises a base cam groove and an insert cam groove.

19. The apparatus of claim 18 in which the base cam groove is wider than the insert cam groove.

20. The apparatus of claim 19 in which the ratio of the slope of the first path to the slope of the second path is within the range of from about 1:2 to about 1:4.

* * * * *